US010415770B2

(12) United States Patent
Zalka et al.

(10) Patent No.: US 10,415,770 B2
(45) Date of Patent: Sep. 17, 2019

(54) LAMP DESIGN WITH LED STEM STRUCTURE

(71) Applicant: General Electric Company, Schenectady, NY (US)

(72) Inventors: Peter Zalka, Budapest (HU); Ede Dolezsar, Budapest (HU); Mate Imre Kovacs, Budapest (HU); Zoltan Harangozo, Budapest (HU); Peter Rona, Budapest (HU)

( * ) Notice: Subject to any disclaimer, the term of this patent is extended or adjusted under 35 U.S.C. 154(b) by 0 days.

(21) Appl. No.: 16/138,181

(22) Filed: Sep. 21, 2018

(65) Prior Publication Data

US 2019/0093834 A1 Mar. 28, 2019

Related U.S. Application Data

(63) Continuation of application No. 14/928,102, filed on Oct. 30, 2015, now abandoned.

(51) Int. Cl.

| | |
|---|---|
| ***F21K 9/90*** | (2016.01) |
| ***F21K 9/232*** | (2016.01) |
| ***F21V 3/04*** | (2018.01) |
| ***F21Y 115/10*** | (2016.01) |
| ***F21Y 107/00*** | (2016.01) |
| ***F21V 3/10*** | (2018.01) |
| ***F21V 3/06*** | (2018.01) |

(52) U.S. Cl.

CPC ..... *F21K 9/90* (2013.01); *F21K 9/232* (2016.08); *F21V 3/049* (2013.01); *F21V 3/0615* (2018.02); *F21V 3/0625* (2018.02); *F21V 3/10* (2018.02); *F21Y 2107/00* (2016.08); *F21Y 2115/10* (2016.08)

(58) Field of Classification Search

CPC .... F21K 9/232; F21K 9/20; F21S 4/22; F21S 4/24; F21S 4/26; F21S 4/28; F21V 3/00; F21V 19/001; F21V 19/003; F21V 19/007; F21V 19/085; F21V 23/002; F21V 23/005; F21V 23/007; F21Y 2107/00; F21Y 2107/30; F21Y 2107/40; F21Y 2107/70

See application file for complete search history.

(56) References Cited

U.S. PATENT DOCUMENTS

| | | | | |
|---|---|---|---|---|
| 6,523,978 | B1 * | 2/2003 | Huang | F21V 3/00 313/500 |
| 6,580,228 | B1 * | 6/2003 | Chen | F21K 9/90 315/185 R |
| 6,621,222 | B1 * | 9/2003 | Hong | F21V 3/02 315/272 |
| 6,709,132 | B2 * | 3/2004 | Ishibashi | F21V 3/00 257/E25.028 |
| 7,354,174 | B1 * | 4/2008 | Yan | F21V 23/005 313/512 |

(Continued)

*Primary Examiner* — Bryon T Gyllstrom
(74) *Attorney, Agent, or Firm* — Wood IP LLC

(57) ABSTRACT

An LED light bulb includes a stand, a plurality of LED light sources supported by the stand and arranged along edges of at least two geometric shapes, and an envelope enclosing the stand and the plurality LED light sources. A method of assembling an LED light bulb includes arranging a plurality of LED light sources along edges of at least two geometric shapes, supporting the arrangement of LED light sources on a stand, and enclosing the plurality of LED light sources and the stand within an envelope.

12 Claims, 7 Drawing Sheets

(56) References Cited

U.S. PATENT DOCUMENTS

| | | | | |
|---|---|---|---|---|
| 8,545,056 | B2 * | 10/2013 | Kajiya | H05K 1/147 362/249.04 |
| 9,373,754 | B2 * | 6/2016 | Hasenoehrl | H01L 25/0753 |
| 9,435,492 | B2 * | 9/2016 | Heikman | F21V 29/004 |
| 9,689,535 | B1 * | 6/2017 | Pinato | F21K 9/232 |
| 10,107,456 | B2 * | 10/2018 | Dau | F21V 19/003 |
| 2005/0174769 | A1 * | 8/2005 | Yong | F21V 3/02 362/235 |
| 2011/0163683 | A1 * | 7/2011 | Steele | F21V 23/02 315/192 |
| 2014/0328058 | A1 * | 11/2014 | Steele | F21V 23/02 362/235 |
| 2016/0363267 | A1 * | 12/2016 | Jiang | F21V 29/70 |
| 2017/0122498 | A1 * | 5/2017 | Zalka | F21K 9/90 |
| 2018/0328543 | A1 * | 11/2018 | Bergmann | F21K 9/232 |
| 2018/0340658 | A1 * | 11/2018 | Lin | F21K 9/232 |
| 2018/0347766 | A1 * | 12/2018 | Choi | F21K 9/237 |
| 2019/0032858 | A1 * | 1/2019 | Cao | F21K 9/232 |
| 2019/0041007 | A1 * | 2/2019 | Cao | F21K 9/90 |
| 2019/0086036 | A1 * | 3/2019 | Hofmann | H01L 25/0753 |
| 2019/0086037 | A1 * | 3/2019 | Cairns | F21K 9/232 |

* cited by examiner

310

LAMP DESIGN WITH LED STEM STRUCTURE

FIELD

The disclosed exemplary embodiments relate generally to lighting systems, and more particularly to light emitting diode (LED) lighting systems.

BACKGROUND

Incandescent light bulbs create light by conducting electricity through a resistive filament and heating the filament to a very high temperature to produce visible light. Incandescent bulbs are made in a wide range of sizes and voltages. The bulbs typically include an enclosure with a tungsten filament inside and a base connector that provides both an electrical and structural support connection. Incandescent bulbs generally mate with a lamp socket having a threaded Edison base connector, bayonet base connector, pin base connector, or any suitable connector for providing electrical power to the bulb. However, incandescent light bulbs are generally inefficient and require frequent replacement. These lamps are in the process of being replaced by more efficient types of electric light such as fluorescent lamps, high-intensity discharge lamps, and, in particular, LED light bulbs.

LED technology continues to advance resulting in improved efficiencies and lower costs with LED light sources found in lighting applications ranging from small pin point sources to stadium lights. LED light strips are available that have a number of LEDs connected together and mounted to a substrate to form a light emitting strip, also referred to as an LED filament. There is a need for different arrangements of LED filaments and corresponding supporting structures.

SUMMARY

The disclosed embodiments are directed to an LED light bulb including a stand, a plurality of LED light sources supported by the stand and arranged along edges of at least two virtual geometric shapes, and an envelope enclosing the stand and the plurality of LED light sources.

In at least one exemplary embodiment, the stand comprises a first frame connected to a first end of the plurality of LED light sources and a second frame connected to a second end of the plurality of LED light sources.

In one or more exemplary embodiments, the first and second frames comprise consecutive segments of electrically conductive and electrically insulating material.

According to some embodiments, the at least two virtual geometric shapes are interleaved.

In further embodiments, the at least two virtual geometric shapes are arranged on a common axis.

In some embodiments, the at least two virtual geometric shapes are arranged on different axes.

In at least one embodiment, the at least two virtual geometric shapes face the same direction.

According to the disclosed embodiments, the at least two virtual geometric shapes face different directions.

In at least one exemplary embodiment, the at least two virtual geometric shapes comprise pyramids.

In further embodiments, the at least two virtual geometric shapes comprise prisms.

The disclosed embodiments are further directed to a method of assembling an LED light bulb including arranging a plurality of LED light sources along edges of at least two virtual geometric shapes, supporting the arrangement of LED light sources on a stand, and enclosing the plurality of LED light sources and the stand within an envelope.

At least one exemplary embodiment includes assembling the stand using a first frame connected to a first end of the plurality of LED light sources and a second frame connected to a second end of the plurality of LED light sources.

One or more exemplary embodiments include constructing the first and second frames of consecutive segments of electrically conductive and electrically insulating material.

Some embodiments further include interleaving the at least two virtual geometric shapes.

Further embodiments include arranging the at least two virtual geometric shapes on a common axis.

The disclosed embodiments include arranging the at least two virtual geometric shapes on different axes.

Some embodiments include arranging the at least two virtual geometric shapes to face the same direction.

At least one embodiment includes arranging the at least two virtual geometric shapes to face different directions.

At least one exemplary embodiment includes arranging the at least two virtual geometric shapes to form pyramids.

The disclosed embodiments also include arranging the at least two virtual geometric shapes to form prisms.

BRIEF DESCRIPTION OF THE DRAWINGS

The foregoing and other aspects of the disclosed embodiments are made more evident in the following Detailed Description, when read in conjunction with the attached Drawing Figures, wherein.

DETAILED DESCRIPTION

The disclosed embodiments are directed to embodiments that utilize one or more arrangements of the LED light sources for providing consistent, even light.

Figure 1:
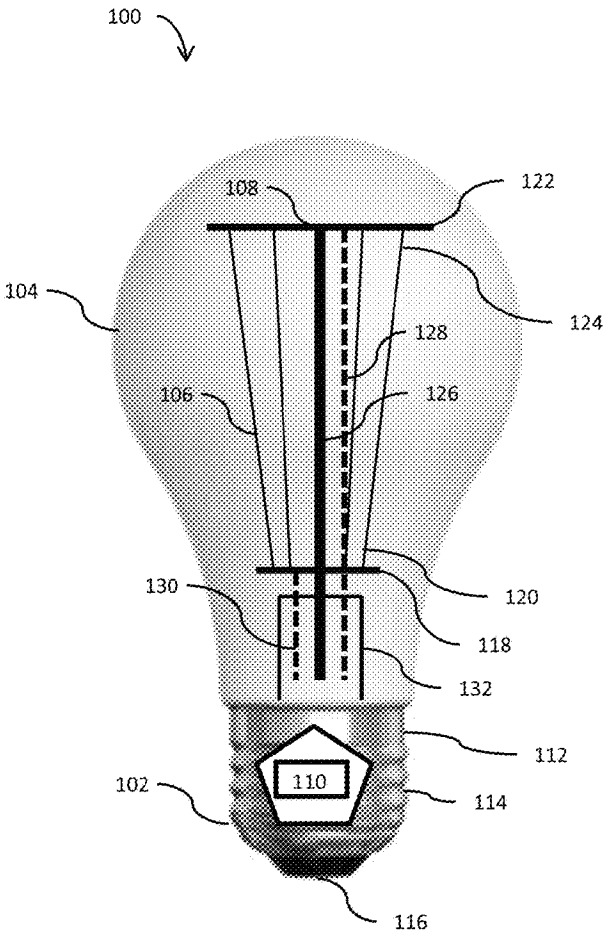
FIG. 1 shows a schematic diagram of an LED light bulb according to the disclosed embodiments.

FIG. 1 is a schematic diagram of an exemplary LED light bulb 100 incorporating the structures and techniques disclosed herein. The light bulb 100 includes a base 102, an envelope 104 and a plurality of LED light sources 106, mounted on a stand arrangement 108 housed within the envelope 104. In at least one embodiment, the LED light sources 106 include one or more LED filaments.

The base may further include a power supply 110 and a base connector 112. The base connector 112 may include electrical contacts, for example contacts 114, 116, for supplying electrical power to power supply 110. In at least one embodiment, contact 114 may be a threaded contact and contact 116 may be a button contact forming a standard Edison base connector. Contacts 114, 116 may connect power supply 110 to a standard 120V or 230V A.C. mains supply or any other suitable external power source. While an E26 base connector is illustrated, it should be understood that the disclosed embodiments may include any E style connector, for example, E11, E12, E17, any bayonet, screw, single or double contact, or mogul connector, or any base connector suitable for use with the disclosed embodiments.

Power supply 110 may include circuitry for conditioning the power provided by contacts 114, 116 for use by the LED light sources 106. In one or more aspects, the power supply 110 may include power conditioning, power conversion, power regulation, power factor correction, polarity correction, or other circuitry as required to adapt power from the external power source to drive the LED light sources 106. In at least one embodiment, power supply 110 may include a rectifier for rectifying an input of 120V or 230V A.C., a DC-DC converter, and filtering components for providing a constant current to the LED light source 106.

Envelope 104 may generally enclose the LED light sources 106 and may be constructed of glass, plastic, translucent ceramic, or other suitable material for transmitting light. While an "A" type envelope is shown, it should be understood that the disclosed embodiments may include AR, B, BR, C, E, ER, G, K, MB, MR, PAR, R, S, T, or any suitable envelope shape. For example, A refers to a classic Edison envelope, B refers to a candle shaped envelope, G refers to a globe shaped envelope, R refers to a reflector envelope, and T refers to a tube shaped envelope. However, the disclosed embodiments may utilize any appropriate envelope profile. At least one surface of envelope 104 may inherently diffuse light or may include a partial coating, frosting, texturing, a light diffusing coating, embedded light scattering particles, may be sandblasted, or may include other material for diffusing light. The envelope 104 may be vacuum sealed and filled with a gas, for example, hydrogen, helium, argon, nitrogen, halogen, xenon, krypton, or any other suitable gas.

The stand arrangement 108 generally includes a first frame 118 at a first end 120 of the LED light sources 106 and a second frame 122 at a second end 124 of the LED light sources 106. The first and second frames 118, 122 may be connected by a support member 126. Alternately, the first and second frames may be supported independently, using separate support members 128, 130. While some of the disclosed embodiments are described as having two frames or four frames, it should be understood that any number of frames may be utilized to provide mounting points for the LED light sources 106. In some embodiments, support members 128, 130 may provide an electrical connection between the power supply 110 and the LED light sources 106. Support members 126, 128, 130 may be embedded in a stem 132 which may be made of glass or any other suitable material.

Figure 2:
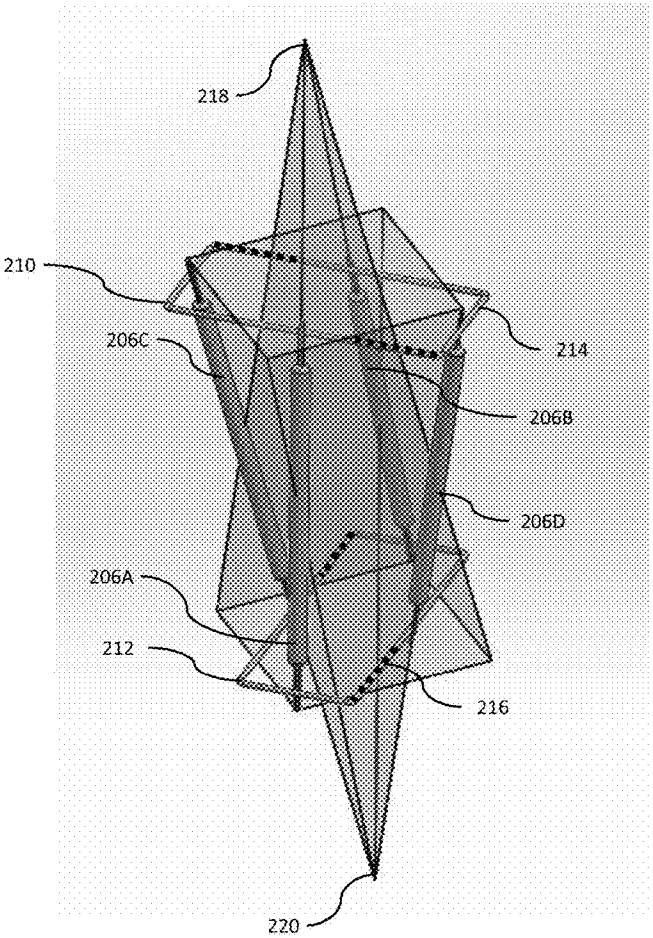
FIG. 2 shows an isometric view of an exemplary arrangement of LED light sources according to the disclosed embodiments.

FIG. 2 shows an isometric view of an exemplary arrangement of a plurality of LED light sources 206A-206D. In this embodiment, LED light sources 206A and 206B may be arranged along a plurality of the edges of a first virtual geometric shape and LED light sources 206C and 206D may be arranged along a plurality of the edges of a second virtual geometric shape. As disclosed herein, a virtual shape includes a shape formed by imaginary lines, some of which extend longitudinally along the LED light sources until the imaginary lines meet or meet with an imaginary base. While various virtual geometric shapes are disclosed herein, it should be understood that any suitable virtual shapes may be included in the disclosed exemplary embodiments. The virtual geometric shapes may be arranged on a common axis or, in other embodiments, may be arranged on different axes. Furthermore, the virtual geometric shapes may face different directions, for example, in opposite or other directions, or may face the same direction. While various quantities of LED light sources are disclosed herein, it should be understood that any suitable number of LED light sources may be used to implement the disclosed exemplary embodiments. In addition, arranging, positioning or otherwise providing an LED light source along an edge of a geometric figure also comprises providing the LED source proximate or parallel to the edge.

In this embodiment, the LED light sources 206A-206D may be supported on two frames, with a first end of LED light sources 206A-206D supported on a first frame 210, and a second end of LED light sources 206A-206D supported on a second frame 212. The first and second frames 210, 212 may include consecutive segments of electrically conductive material 214 and electrically insulating material 216. Different configurations of the electrically conductive segments 214 and electrically insulating segments 216 may be arranged to provide different power distributions to the plurality of light sources 206A-206D. For example, the electrically conductive segments 214 and electrically insulating segments 216 may be arranged to provide power to the LED light sources 206A-206D in parallel, in series, or in different combinations of parallel and series configurations.

The virtual geometric shapes may be interleaved in that they are positioned within each other. In this exemplary embodiment, the LED light sources 206A and 206B and LED light sources 206C and 206D may be arranged along a plurality of edges of virtual interleaved pyramids with LED light sources 206A and 206B arranged along a plurality of edges of virtual pyramid 218, and LED light sources 206C and 206D arranged along a plurality of edges of virtual pyramid 220. While the virtual pyramids 218, 220 may be illustrated as facing in opposite directions and having a common axis, it should be understood that the virtual pyramids may be arranged on different axes, and may face the same or other different directions. Furthermore, while the arrangement of FIG. 2 shows four LED light sources 206A, 206B, 206C, 206D arranged along edges of two virtual pyramids 218, 220 it should be understood that the disclosed embodiments may include any suitable number of LED light sources arranged along any number of edges of any suitable number of virtual pyramids.

Figure 3:
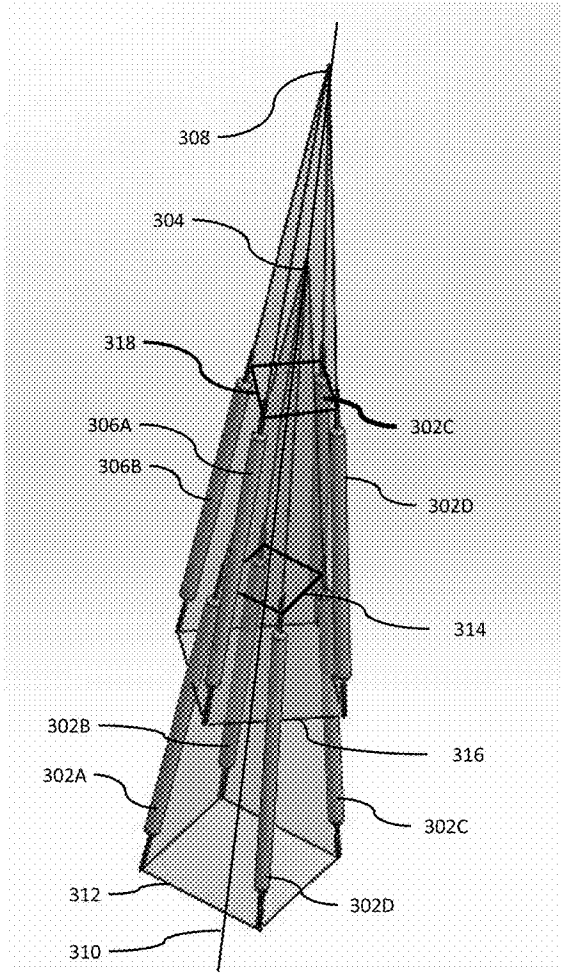
FIG. 3 shows an isometric view of another exemplary arrangement of LED light sources.

FIG. 3 shows an isometric view of another arrangement of LED light sources positioned along edges of virtual geometric figures. In this embodiment, LED light sources 302A, 302B, 302C, 302D may be arranged along the edges of virtual pyramid 304, and LED light sources 306A, 306B, 306C, 306D may be arranged along the edges of virtual pyramid 308. The virtual pyramids 304, 308, may be offset longitudinally and rotated with respect to each other around a longitudinal axis 310. It should be understood that any suitable longitudinal offset and any suitable amount of rotation with respect to the disclosed geometric figures are included in the disclosed embodiments. LED light sources 302A, 302B, 302C, 302D may be supported by frames 312 and 314, while LED light sources 306A, 306B, 306C, 306D may be supported by frames 316 and 318. Frames 312, 314, 316, 318 may include different configurations of consecutive segments of electrically conductive and electrically insulating material (not shown in FIG. 3) similar to frames 210, 212 shown in FIG. 2. It should be understood that any number of frames may be utilized to provide mounting points for the LED light sources 302A, 302B, 302C, 302D, 306A, 306B, 306C, and 306D.

Figure 4:
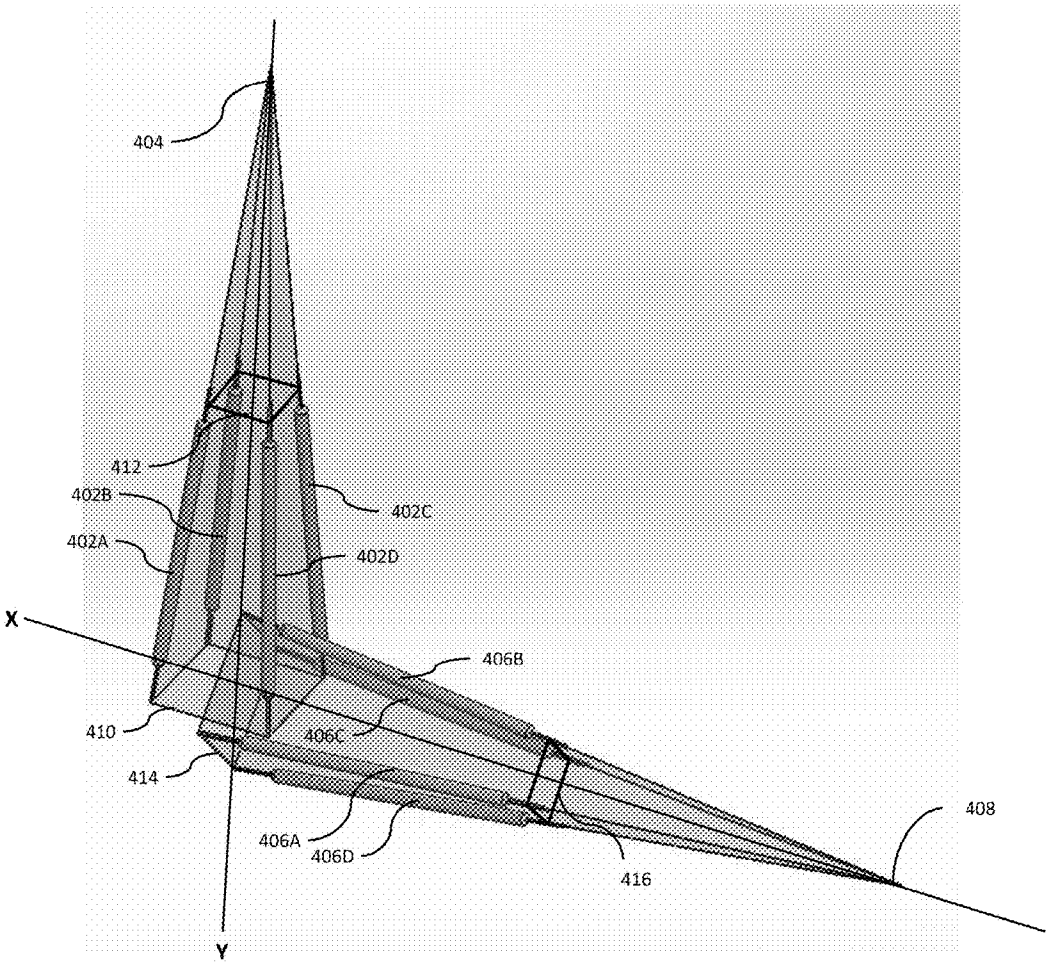
FIG. 4 shows an isometric view of still another exemplary arrangement of LED light sources.

FIG. 4 shows an isometric view of another exemplary arrangement of LED light sources positioned along edges of virtual geometric figures. In this embodiment, LED light sources 402A, 402B, 402C, 402D may be positioned along the edges of virtual pyramid 404, and LED light sources 406A, 406B, 406C, 406D may be positioned along the edges of virtual pyramid 408. Virtual pyramid 408 may be rotated 90 degrees with respect to virtual pyramid 404 resulting in virtual pyramids 404, 408, being positioned perpendicular to each other with virtual pyramid 404 extending longitudinally along a Y axis and virtual pyramid 408 extending longitudinally along an X axis. In this embodiment, virtual pyramid 408 may also be rotated 90 degrees around the X axis. It should be understood that the disclosed embodiments include any suitable rotations with respect to the virtual geometric figures or their axes. Frames 410 and 412 may be used to support LED light sources 402A, 402B, 402C, 402D, and frames 414 and 416 may be used to support LED light sources 406A, 406B, 406C, 406D. Frames 410, 412, 414, 416 may include different configurations of consecutive segments of electrically conductive and electrically insulating material (not shown in FIG. 4) similar to frames 210, 212 shown in FIG. 2.

Figure 5:
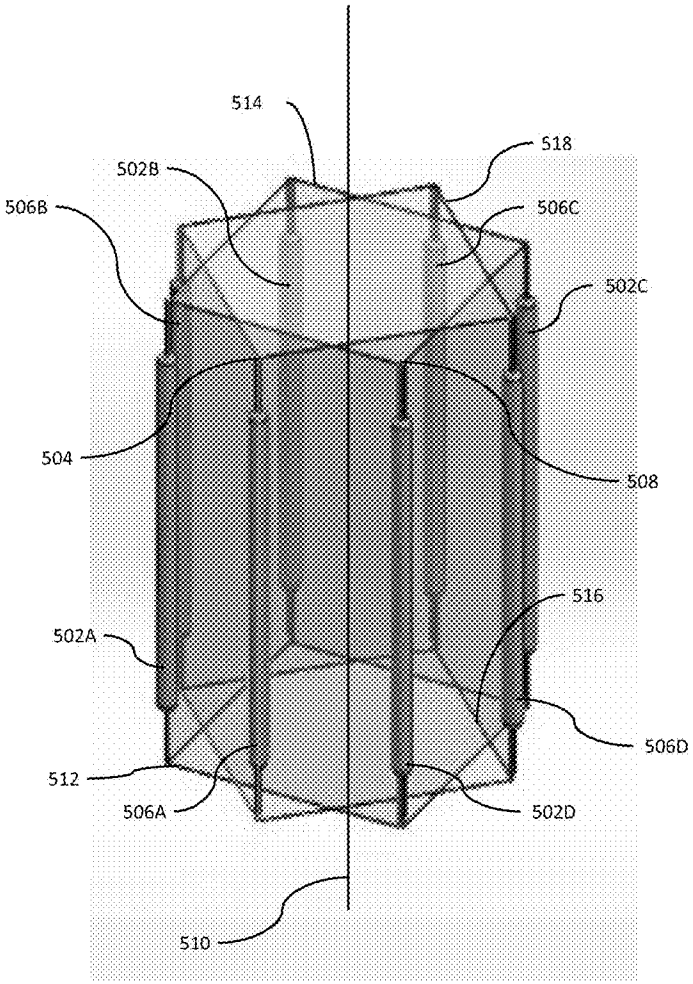
FIG. 5 shows an isometric view of yet another arrangement of LED light sources.

FIG. 5 shows an isometric view of another exemplary embodiment where LED light sources may be arranged along edges of virtual geometric figures. In this example, LED light sources 502A, 502B, 502C, 502D may be arranged along the edges of virtual cuboid 504, and LED light sources 506A, 506B, 506C, 506D may be arranged along the edges of virtual cuboid 508. The virtual cuboids 504, 508 share a common center axis 510, and in addition, cuboid 504 may be rotated 45 degrees around the common axis 510 with respect to cuboid 508. In this embodiment, LED light sources 502A, 502B, 502C, 502D may be supported by frames 512 and 514, while LED light sources 506A, 506B, 506C, 506D may be supported by frames 516 and 518. Similar to frames 210, 212 shown in FIG. 2, frames 512, 514, 516, 518 may include different configurations of consecutive segments of electrically conductive and electrically insulating material.

Figure 6:
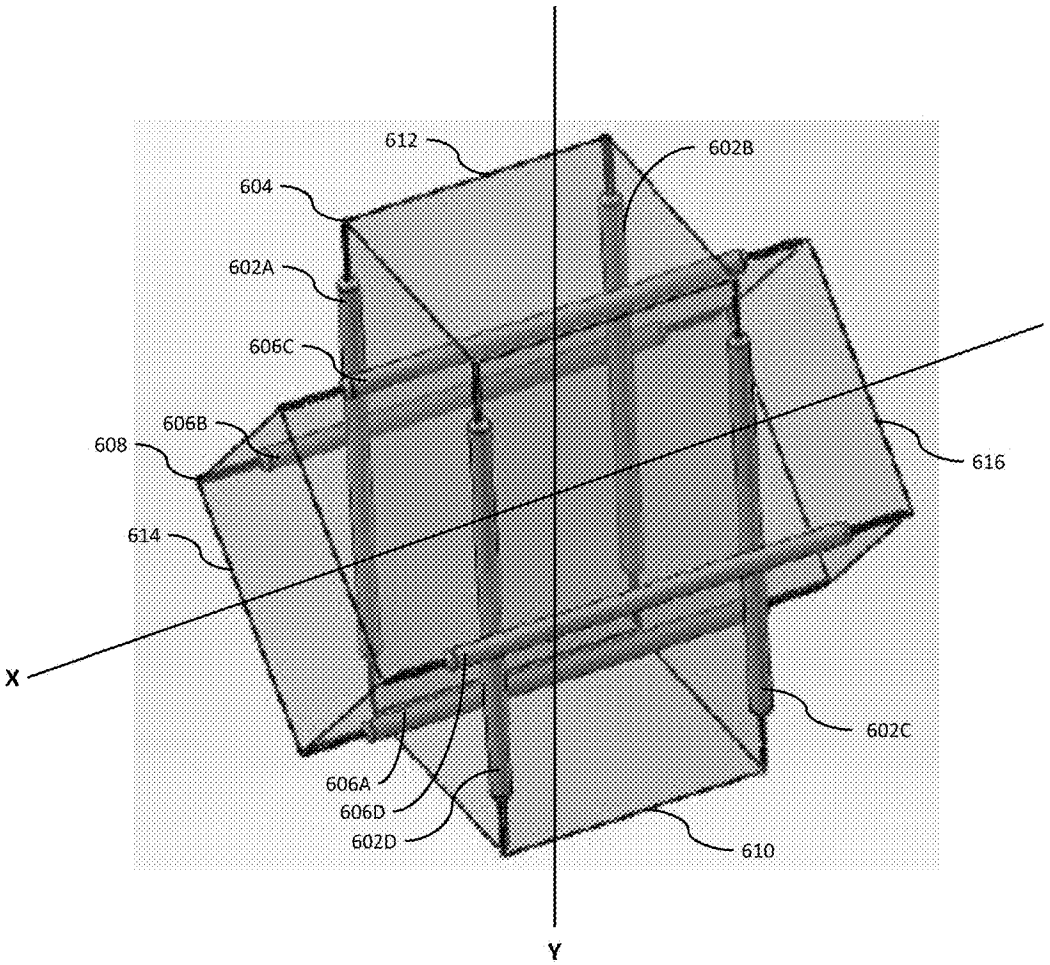
FIGS. 6 and 7 also show isometric views of additional arrangements of LED light sources, according to the disclosed embodiments.

FIG. 6 shows an isometric view of yet another exemplary arrangement of LED light sources positioned along edges of virtual geometric figures. The exemplary arrangement of FIG. 6 includes LED light sources 602A, 602B, 602C, 602D positioned along the edges of virtual cuboid 604, and LED light sources 606A, 606B, 606C, 606D positioned along the edges of virtual cuboid 608. Virtual cuboids 604 and 608 may be positioned perpendicular to each other, for example, by rotating virtual cuboid 608 90 degrees with respect to virtual cuboid 604, resulting in virtual cuboid 604 extending longitudinally along a Y axis and virtual cuboid 608 extending longitudinally along an X axis. Virtual cuboid 608 may also be rotated 45 degrees around the X axis. As mentioned above, it should be understood that the disclosed embodiments include any suitable rotations with respect to the virtual geometric figures or their axes. Frames 610 and 612 may be used to support LED light sources 602A, 602B, 602C, 602D, and frames 614 and 616 may be used to support LED light sources 606A, 606B, 606C, 606D. Frames 610, 612, 614, 616 may include different configurations of consecutive segments of electrically conductive and electrically insulating material similar to frames 210, 212 shown in FIG. 2.

Figure 7:
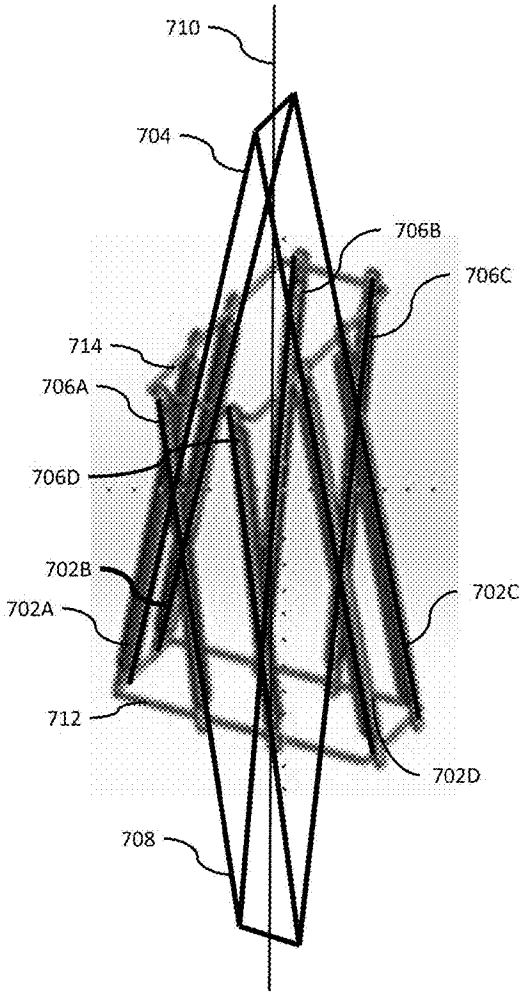

FIG. 7 shows another embodiment of LED light sources positioned along edges of a virtual geometric shape. In this exemplary embodiment, the LED light sources 702A, 702B, 702C, 702D, and 706A, 706B, 706C, 706D, may be arranged along the edges of virtual interleaved triangular prisms 704 and 708, respectively. While the virtual triangular prisms 704, 708 may be illustrated as facing in opposite directions and having a common axis 710, it should be understood that the virtual triangular prisms 704, 708 may be arranged on different axes, and may face the same or other different directions. Furthermore, while the arrangement of FIG. 7 shows LED light sources 702A, 702B, 702C, 702D, and 706A, 706B, 706C, 706D, arranged along the edges of two virtual triangular prisms 704 and 708, respectively, it should be understood that any suitable number of LED light sources may be arranged along edges of any suitable number of virtual triangular prisms. As shown in this embodiment, LED light sources 702A, 702B, 702C, 702D may be supported by frames 712 and 714, and LED light sources 706A, 706B, 706C, 706D may be supported by the same frames. Similar to frames 210, 212 shown in FIG. 2, frames 712, 714 may include different configurations of consecutive segments of electrically conductive and electrically insulating material.

The disclosed embodiments provide structures and techniques for arranging LED light sources in different configurations. Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. An LED light bulb comprising:

a stand comprising multiple frames, wherein each frame includes consecutive alternating segments of electrically conductive material for supplying power and electrically insulating material;

a plurality of filament LED light sources comprising a first set of filament LED light sources and a second set of filament LED light sources arranged along outer edges of at least two virtual geometric shapes, wherein each virtual geometric shape including a cuboid, pyramid, or prism, and the first set of filament LED light sources are arranged along separate outer edges of a first virtual geometric shape and the second set of filament LED light sources are arranged along separate outer edges of a second virtual geometric shape of the at least two virtual geometric shapes wherein the at least two virtual geometric shapes are in contact with one another and one frame is connected to respective ends of the plurality of filament LED light sources and another frame is connected to opposite ends of the respective ends of the plurality of filament LED light sources; and an envelope enclosing the stand and the plurality of filament LED light sources.

2. The LED light bulb of claim 1, wherein the at least two virtual geometric shapes are interleaved.

3. The LED light bulb of claim 1, wherein the at least two virtual geometric shapes are arranged on a common axis.

4. The LED light bulb of claim 1, wherein the at least two virtual geometric shapes are arranged on different axes.

5. The LED light bulb of claim 1, wherein the at least two virtual geometric shapes face the same direction.

6. The LED light bulb of claim 1, wherein the at least two virtual geometric shapes face different directions.

7. The LED light bulb of claim 1, wherein the plurality of filament LED light sources comprise at least four filament LED light sources, and the stand comprises at least two frames.

8. The LED light bulb of claim 1, wherein the envelope is sealed and filled with a gas comprising hydrogen, helium, argon, nitrogen, halogen, xenon, or krypton.

9. The LED light bulb of claim 1, wherein the electrically conductive segments and the electrically insulating segments are arranged to supply power to the filament LED light sources in different combinations of parallel and series configurations.

10. An LED light bulb comprising:

a stand comprising multiple frames, wherein each frame includes consecutive alternating segments of electrically conductive material for supplying power and electrically insulating material;

a plurality of filament LED light sources comprising a first set of filament LED light sources and a second set of filament LED light sources arranged along outer edges of at least two virtual geometric shapes, wherein each virtual geometric shape enclosing a space, and the first set of filament LED light sources being arranged along separate outer edges of first virtual geometric shape and the second set of filament LED light sources being arranged along separate outer edges of a second virtual geometric shape of the at least two virtual geometric shapes, wherein the at least two virtual geometric shapes are interleaved and offset longitudinally and rotated with respect to each other, and wherein one frame is connected to respective ends of the first set of filament LED light sources and another frame is connected to respective ends of the second set of filament LED light sources; and an envelope enclosing the stand and the plurality of filament LED light sources.

11. An LED bulb comprising: a stand comprising multiple frames wherein each frame includes alternating consecutive segments of electrically conductive material for supplying power and electrically insulating material;

a plurality of filament LED light sources comprising a first set of filament LED light sources and a second set of filament LED light sources arranged along outer edges of at least two virtual geometric shapes, wherein each virtual geometric shape enclosing a space and the first set of filament LED light sources are arranged along separate outer edges of a first virtual geometric shape and the second set of filament LED light sources are arranged along separate outer edges of a second virtual geometric shape of the at least two virtual geometric shapes and the at least two virtual geometric shapes share a common center axis while the second virtual geometric shape is rotated around the common center axis with respect to the first virtual geometric shape, wherein one frame is connected to respective ends of the first set of filament LED light sources and another frame is connected to respective ends of the second set of filament LED light sources; and an envelope enclosing the stand and the plurality of filament LED light sources.

12. The LED light bulb of claim 10, wherein the multiple frames comprise a first set of frames connected to respective ends of the first set of filament LED light sources and a second set of frames connected to respective ends of the second set of filament LED light sources.

* * * * *